US011121479B2

(12) United States Patent
Komoto et al.

(10) Patent No.: US 11,121,479 B2
(45) Date of Patent: Sep. 14, 2021

(54) CONNECTOR AND CONNECTING METHOD

(71) Applicant: Japan Aviation Electronics Industry, Limited, Tokyo (JP)

(72) Inventors: Tetsuya Komoto, Tokyo (JP); Akihiro Matsunaga, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/910,862

(22) Filed: Jun. 24, 2020

(65) Prior Publication Data

US 2021/0098898 A1 Apr. 1, 2021

(30) Foreign Application Priority Data

Sep. 26, 2019 (JP) ..... JP2019-174852

(51) Int. Cl.
*H01R 4/24* (2018.01)
*H01R 24/20* (2011.01)
(Continued)

(52) U.S. Cl.
CPC ..... *H01R 4/24* (2013.01); *H01R 24/20* (2013.01); *H01R 24/28* (2013.01); *H01R 43/20* (2013.01)

(58) Field of Classification Search
CPC ..... H01R 4/24; H01R 24/20; H01R 24/28; H01R 43/20
(Continued)

(56) References Cited

U.S. PATENT DOCUMENTS 2,764,748 A * 9/1956 Heller ..... H01R 4/50 439/393
3,519,980 A * 7/1970 Mosley ..... H01R 24/28 439/459
(Continued)

FOREIGN PATENT DOCUMENTS

GB 2047984 A 12/1980
JP 2005122901 A 5/2005

OTHER PUBLICATIONS

European Search Report dated Oct. 21, 2020 in EP Application No. 20187447.6 (16 pages).

*Primary Examiner* — Neil Abrams
(74) *Attorney, Agent, or Firm* — Muncy, Geissler, Olds & Lowe, P.C.

(57) ABSTRACT

A connector includes a base member having two or more projections, two or more contacts, a housing holding the contacts and facing the base member, and a cutting portion for cutting the flexible conductor between a pair of contacts to divide the flexible conductor into a pair of flexible conductor pieces, when projections corresponding to the contacts are separately inserted into projection accommodating portions of the contacts together with the flexible conductor, the flexible conductor being arranged between the base member and the housing and extending over the contacts adjacent to each other, the flexible conductor pieces divided by the cutting portion being sandwiched between lateral surfaces of the projections and inner surfaces of the projection accommodating portions of the contacts and coming into contact with the inner surfaces of the projection accommodating portions of the contacts, whereby the contacts are electrically connected to the flexible conductor pieces.

16 Claims, 8 Drawing Sheets

(51) Int. Cl.
*H01R 24/28* (2011.01)
*H01R 43/20* (2006.01)

(58) Field of Classification Search
USPC ..... 392/392, 656
See application file for complete search history.

(56) References Cited

U.S. PATENT DOCUMENTS 3,596,232 A * 7/1971 Medley ..... H01R 4/28 439/410
4,075,758 A * 2/1978 Parsons ..... H01R 25/00 29/866
4,181,395 A * 1/1980 Grabowski ..... H01R 25/165 174/72 R
4,444,448 A * 4/1984 Silbernagel ..... H01R 4/2445 439/392
4,725,247 A * 2/1988 Fremgen ..... H01R 4/245 439/392
5,238,424 A * 8/1993 Vindum ..... H01R 12/67 439/425
5,252,091 A * 10/1993 Fujita ..... H01R 25/14 439/499
5,967,818 A * 10/1999 Carron ..... H01R 25/16 439/211
6,027,367 A * 2/2000 Woertz ..... H01R 4/2483 439/497
6,848,933 B1 * 2/2005 Delaney, III ..... H01R 25/145 439/392
8,647,155 B2 * 2/2014 Hung ..... H01R 11/32 439/658
9,450,314 B2 * 9/2016 Braun ..... H01R 13/5205
10,096,918 B1 * 10/2018 Nakamura ..... H01R 13/502
10,199,770 B2 * 2/2019 Komoto ..... H01R 13/74
10,617,155 B2 * 4/2020 Komoto ..... H01R 13/73
10,868,380 B1 * 12/2020 Komoto ..... H01R 13/73
10,886,650 B1 * 1/2021 Komoto ..... H01R 12/778
10,923,855 B2 * 2/2021 Matsuo ..... H01R 13/642
2009/0208168 A1 * 8/2009 Ishikawa ..... H01R 13/639 385/14
2018/0233854 A1 8/2018 Komoto et al.
2018/0269606 A1 9/2018 Nakamura
2021/0075146 A1 * 3/2021 Matsuo ..... H01R 13/5025
2021/0098898 A1 * 4/2021 Komoto ..... H01R 43/20

* cited by examiner

CONNECTOR AND CONNECTING METHOD

BACKGROUND OF THE INVENTION

The present invention relates to a connector and a connecting method, particularly to a connector to be connected to a flexible conductor.

As a connector connected to a flexible conductor, for instance, JP 2005-122901 A discloses a connector 1 illustrated in FIG. 18. The connector 1 is mounted on a flexible flat cable 2 and includes a metal plate 4 including a piercing piece 3 and a metal receiving groove plate 6 provided with a receiving groove 5.

When the piercing piece 3 of the metal plate 4 is pierced into the flat cable 2 while the metal plate 4 and the receiving groove plate 6 are aligned with each other such that the piercing piece 3 may be inserted along one end of the receiving groove 5, a flexible conductor 7 in the flat cable 2 is sheared by the piercing piece 3, and along with the insertion of the piercing piece 3, the sheared portion of the flexible conductor 7 is caught into a gap formed between the other end of the receiving groove 5 and the piercing piece 3 to become a stretch cutting portion 7A and comes into contact with the piercing piece 3. As a result, the metal plate 4 and the flexible conductor 7 are electrically connected to each other.

As illustrated in FIG. 18, when the piercing piece 3 pierces the flat cable 2, the flexible conductor 7 is sheared and divided into two conductor portions located on both sides of the piercing piece 3. However, of the divided two conductor portions, only one conductor portion including the stretch cutting portion 7A is electrically connected to the metal plate 4 to form an electric circuit, and the other conductor portion including no stretch cutting portion 7A does not contribute to the electric circuit and becomes useless.

Accordingly, for connecting a plurality of metal plates 4 to a plurality of flexible conductors 7, one metal plate 4 must be arranged for each flexible conductor 7, requiring a large amount of work to form a plurality of electric circuits disadvantageously.

SUMMARY OF THE INVENTION

The present invention has been made to solve the conventional problem, and an object of the present invention is to provide a connector capable of easily electrically connecting a plurality of contacts to a plurality of flexible conductor pieces.

Another object of the present invention is to provide a connecting method for easily electrically connecting a plurality of contacts to a plurality of flexible conductor pieces.

A connector according to the present invention is a connector to be connected to a flexible conductor, the connector comprising:

a base member including two or more projections;

two or more contacts made of a conductive material and including projection accommodating portions of recess shape into which the two or more projections are separately inserted;

a housing holding the two or more contacts and arranged to face the base member; and a cutting portion for cutting the flexible conductor between a pair of contacts among the two or more contacts to divide the flexible conductor into a pair of flexible conductor pieces, when a pair of projections corresponding to the pair of contacts among the two or more projections are separately inserted into the projection accommodating portions of the pair of contacts together with the flexible conductor, the flexible conductor being arranged between the base member and the housing and extending over the pair of contacts adjacent to each other, wherein the pair of flexible conductor pieces divided by the cutting portion are sandwiched between lateral surfaces of the pair of projections and inner surfaces of the projection accommodating portions of the pair of contacts and come into contact with the inner surfaces of the projection accommodating portions of the pair of contacts, whereby the pair of contacts are electrically connected to the pair of flexible conductor pieces.

A connector method according to the present invention is a method for connecting a pair of contacts held on a housing to a pair of flexible conductor pieces, the connecting method comprising:

arranging a pair of projections formed on a base member so as to face projection accommodating portions of recess shape of the pair of contacts;

arranging a flexible conductor between the housing and the base member so as to extend over the pair of contacts; and pushing the housing and the base member to each other with the flexible conductor being sandwiched therebetween to insert the pair of projections into the projection accommodating portions of the pair of contacts together with the flexible conductor and to cut the flexible conductor between the pair of contacts with a cutting portion arranged on at least one of the housing and the base member so as to divide the flexible conductor into a pair of flexible conductor pieces, and sandwiching the pair of flexible conductor pieces between lateral surfaces of the pair of projections and inner surfaces of the projection accommodating portions of the pair of contacts to bring the pair of flexible conductor pieces into contact with the inner surfaces of the projection accommodating portions of the pair of contacts, whereby the pair of contacts are electrically connected to the pair of flexible conductor pieces.

DETAILED DESCRIPTION OF THE INVENTION

Hereinbelow, embodiments of the present invention will be described with reference to the accompanying drawings.

Embodiment 1

Figure 1:
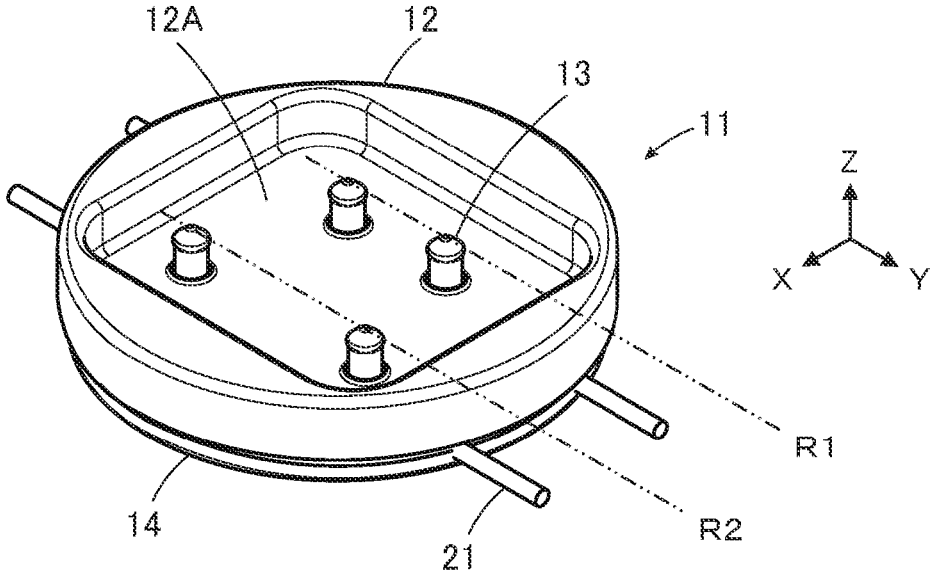
FIG. 1 is a perspective view of a connector according to Embodiment 1 of the present invention as viewed obliquely from above.
Figure 2:
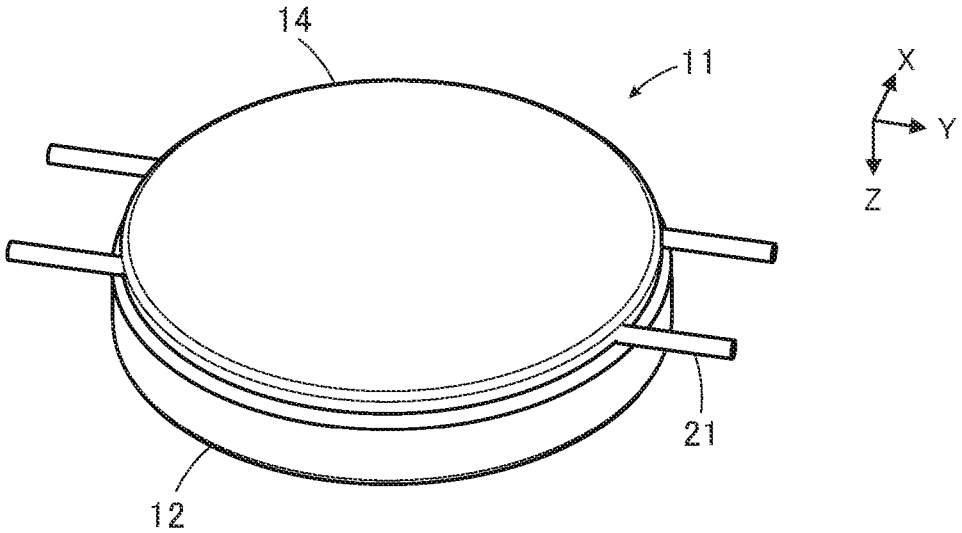
FIG. 2 is a perspective view of the connector according to Embodiment 1 as viewed obliquely from below.

FIGS. 1 and 2 illustrate a connector 11 according to Embodiment 1. The connector 11 is used as, for example, a garment-side connector portion for fitting a wearable device, and is connected to a plurality of flexible conductor pieces 21.

The connector 11 includes a housing 12, a plurality of contacts 13, and a base member 14 facing the housing 12 with the plurality of flexible conductor pieces 21 being sandwiched between the base member 14 and the housing 12, and the plurality of contacts 13 and the plurality of flexible conductor pieces 21 are electrically connected to each other. The housing 12 has a recess 12A within which the plurality of contacts 13 project perpendicularly to a planar bottom surface of the recess 12A.

As the flexible conductor piece 21, a conductive yarn produced by twisting a plurality of conductive fibers is used.

Here, for convenience, the bottom surface of the recess 12A of the housing 12 is defined as extending along an XY plane, and a direction in which the respective contacts 13 project is referred to as the +Z direction.

The plurality of flexible conductor pieces 21 are arranged on the −Z direction side of the housing 12, and the base member 14 is arranged on the −Z direction side of the plurality of flexible conductor pieces 21.

As the plurality of contacts 13, a total of four contacts 13 arrayed in two rows including a first row R1 and a second row R2 are arranged. Each of the first row R1 and the second row R2 extends along the Y direction and includes a pair of neighboring contacts 13. Also, the first row R1 and the second row R2 are separated from each other in the X direction, and the second row R2 is arranged on the +X direction side of the first row R1.

Figure 3:
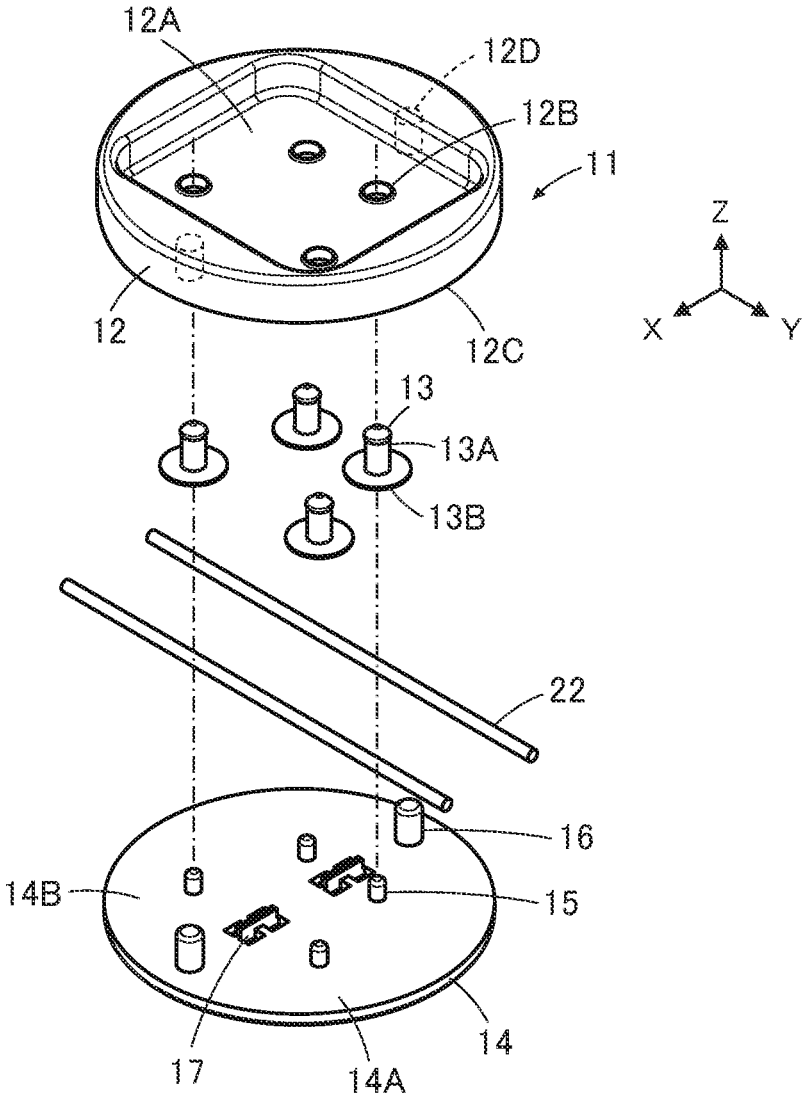
FIG. 3 is an assembly view of the connector according to Embodiment 1 as viewed obliquely from above.
Figure 4:
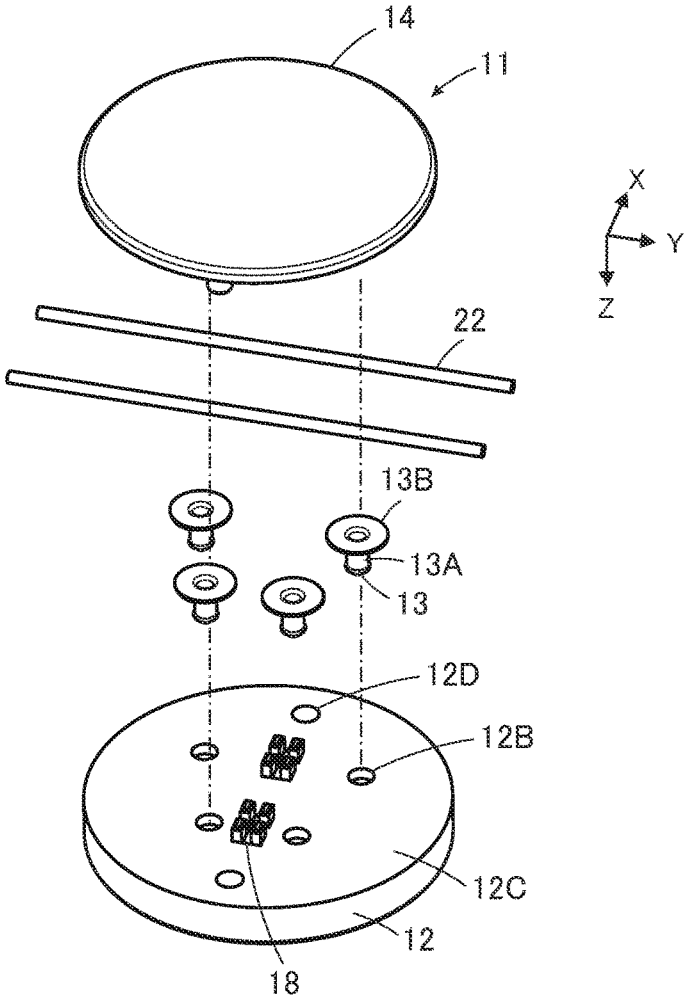
FIG. 4 is an assembly view of the connector according to Embodiment 1 as viewed obliquely from below.

FIGS. 3 and 4 illustrate assembly views of the connector 11. The housing 12 is made of an insulating material such as insulating resin and is provided with four contact through-holes 12B within the recess 12A opening in the +Z direction. The recess 12A constitutes a counter connector accommodating portion in which a part of a counter connector (not illustrated) is to be accommodated. The four contact through-holes 12B correspond to the four contacts 13 on a one-to-one basis. Also, two post accommodating portions 12D of recess shape are formed in positions outside the recess 12A in the XY direction and at a surface 12C of the housing 12 facing in the −Z direction.

The four contacts 13 are plug-type contacts made of a conductive material such as metal and are to be connected to corresponding contacts of the counter connector (not illustrate) when a part of the counter connector is accommodated in the recess 12A of the housing 12. Each contact 13 has a tubular portion 13A in the shape of a cylindrical tube extending in the Z direction and a flange 13B extending from the −Z directional end of the tubular portion 13A along an XY plane.

The base member 14 is made of an insulating material such as insulating resin and has a flat plate portion 14A. Four projections 15 corresponding to the four contacts 13 project on a surface 14B of the flat plate portion 14A facing in the +Z direction. In addition, two housing fixing posts 16 longer in projecting height than the projections 15 project from the surface 14B of the flat plate portion 14A. These two housing fixing posts 16 independently correspond to the two post accommodating portions 12D of recess shape of the housing 12.

Each of the four contact through-holes 12B of the housing 12, each of the four contacts 13, and each of the four projections 15 of the base member 14 are arranged to correspond to one another in position.

Similarly, each of the two post accommodating portions 12D of the housing 12 and each of the two housing fixing posts 16 of the base member 14 are arranged to correspond to one another in position.

Also, as illustrated in FIG. 3, two cutting protrusion portions 17 are arranged on the surface 14B, facing in the +Z direction, of the flat plate portion 14A of the base member 14, and as illustrated in FIG. 4, two cutting grooves 18 are arranged on the surface 12C, facing in the −Z direction, of the housing 12. Each of the two cutting protrusion portions 17 of the base member 14 and each of the two cutting grooves 18 of the housing 12 are arranged to correspond to one another in position. Also, each cutting protrusion portion 17 and the corresponding cutting groove 18 constitute a cutting portion in the present invention.

Two flexible conductors 22 are arranged between the four contacts 13 and the base member 14. Each flexible conductor 22 is made of a conductive yarn produced by twisting a plurality of conductive fibers. When the connector 11 is assembled, the flexible conductor 22 is cut into the two flexible conductor pieces 21 due to the effect of the cutting protrusion portion 17 of the base member 14 and the cutting groove 18 of the housing 12, and the two flexible conductor pieces 21 are independently connected to the two corresponding contacts 13.

Figure 5:
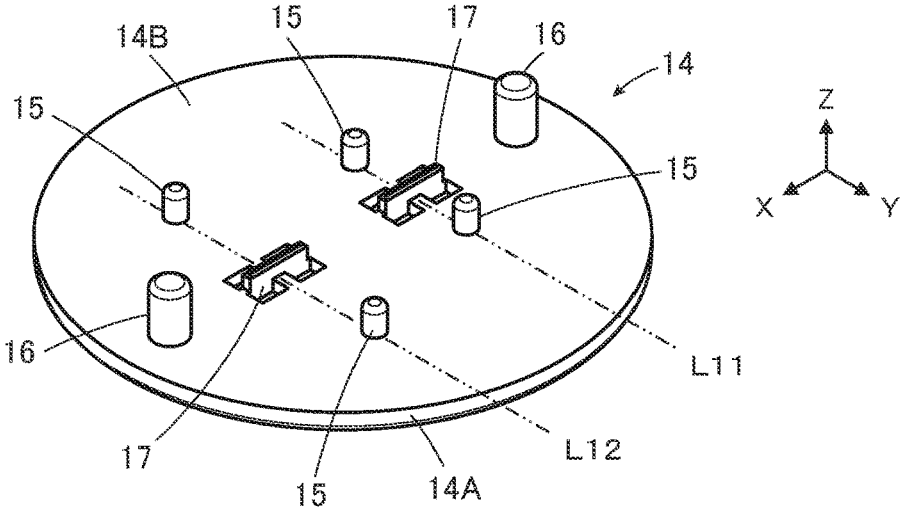
FIG. 5 is a perspective view of a base member for use in the connector according to Embodiment 1 as viewed obliquely from above.

As illustrated in FIG. 5, the four projections 15 of the base member 14 correspond to the four contacts 13 and include a pair of projections 15 adjacent to each other in the Y direction on a straight line L11 extending along the Y direction (first direction) and a pair of projections 15 adjacent to each other in the Y direction on a straight line L12 located on the +X direction side of the straight line L11 and extending along the Y direction (first direction).

The pair of projections 15 arranged on the straight line L11 correspond to the pair of contacts 13 forming the first row R1, and one cutting protrusion portion 17 is arranged between the pair of projections 15 on the straight line L11. Similarly, the pair of projections 15 arranged on the straight line L12 correspond to the pair of contacts 13 forming the second row R2, and the other cutting protrusion portion 17 is arranged between the pair of projections 15 on the straight line L12.

Figure 6:
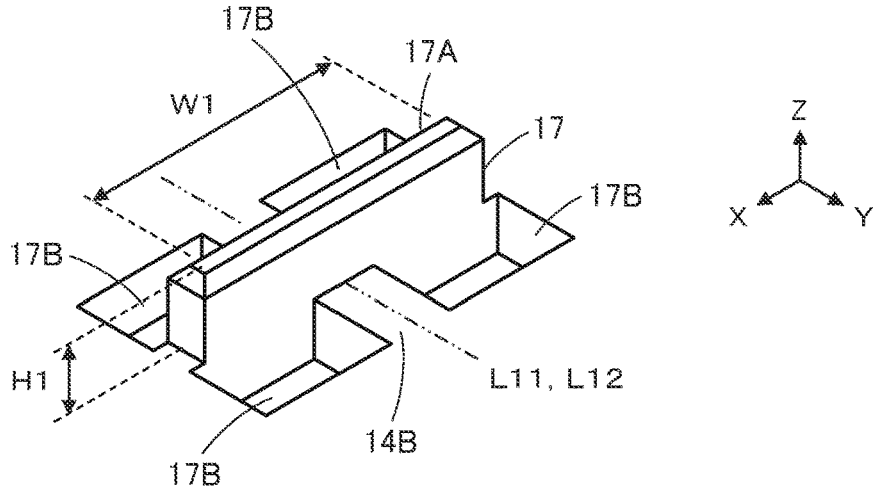
FIG. 6 is an enlarged perspective view illustrating a cutting protrusion portion formed on the base member for use in the connector according to Embodiment 1.

As illustrated in FIG. 6, the cutting protrusion portion 17 has a flat plate shape extending in the X direction and protruding in the +Z direction from the surface 14B of the flat plate portion 14A, facing in the +Z direction, of the base member 14 and is provided at the +Z directional end thereof with a tip end portion 17A extending along the X direction. The tip end portion 17A has a width W1 longer than the width (diameter) of the flexible conductor 22 along the X direction (second direction) perpendicular to the straight lines L11 and L12. A projecting height H1 of the cutting protrusion portion 17 from the surface 14B of the flat plate portion 14A to the tip end portion 17A is shorter than the projecting height of the projection 15 from the surface 14B of the flat plate portion 14A.

In addition, on the surface 14B of the flat plate portion 14A, a total of four rectangular accommodating grooves 17B are formed on the +Y direction side and the −Y direction side of the cutting protrusion portion 17 with the cutting protrusion portion 17 being sandwiched therebetween and on the +X direction side and the −X direction side of the straight line L11 or L12 with the straight line L11 or L12 being sandwiched therebetween.

Figure 7:
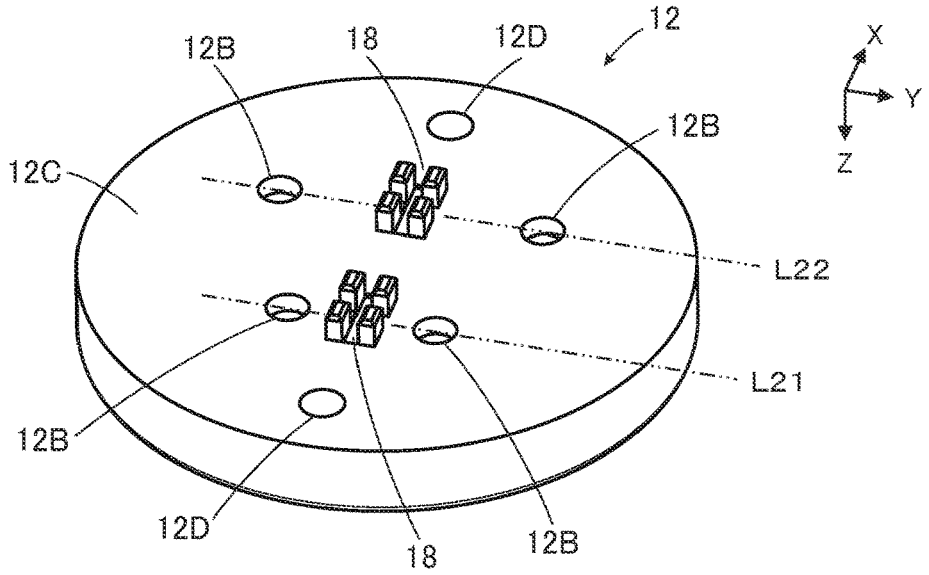
FIG. 7 is a perspective view of a housing for use in the connector according to Embodiment 1 as viewed obliquely from below.

As illustrated in FIG. 7, the four contact through-holes 12B of the housing 12 correspond to the four contacts 13 and include a pair of contact through-holes 12B adjacent to each other in the Y direction on a straight line L21 extending along the Y direction (first direction) and a pair of contact through-holes 12B adjacent to each other in the Y direction on a straight line L22 located on the +X direction side of the straight line L21 and extending along the Y direction (first direction).

The pair of contact through-holes 12B arranged on the straight line L21 correspond to the pair of contacts 13 forming the first row R1, and one cutting groove 18 is arranged between the pair of contact through-holes 12B on the straight line L21. Similarly, the pair of contact through-holes 12B arranged on the straight line L22 correspond to the pair of contacts 13 forming the second row R2, and the other cutting groove 18 is arranged between the pair of contact through-holes 12B on the straight line L22.

Figure 8:
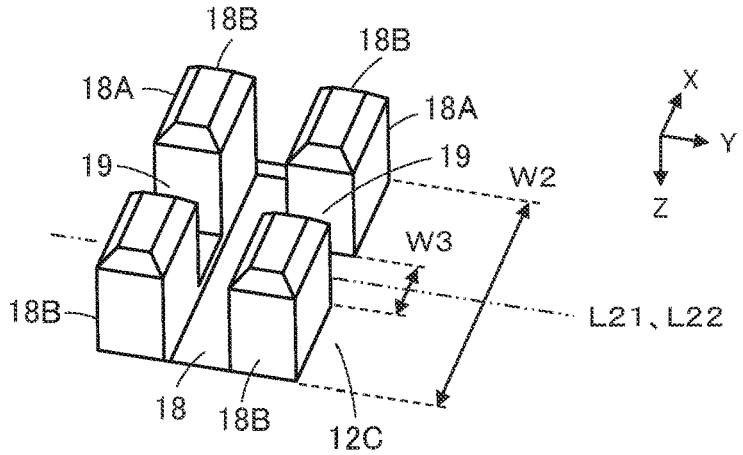
FIG. 8 is an enlarged perspective view illustrating a cutting groove formed on the housing.

As illustrated in FIG. 8, the cutting groove 18 is a groove extending along the X direction. A pair of guide portions 18A projecting toward the −Z direction are independently formed on the +Y direction side and the −Y direction side of the cutting groove 18 with the cutting groove 18 being sandwiched therebetween on the surface 12C, facing in the −Z direction, of the housing 12, and the cutting groove 18 is formed between the pair of guide portions 18A. The bottom surface of the cutting groove 18 is recessed farther in the −Z direction than the surface 12C, facing in the −Z direction, of the housing 12.

Also, each pair of guide portions 18A is divided into a pair of guide pieces 18B arranged separately on the +X direction side and the −X direction side of the straight line L21 or L22, and a total of four guide pieces 18B are formed around the cutting groove 18. Recesses 19 arranged on the straight line L21 or L22 are formed between two pairs of guide pieces 18B, out of the four guide pieces 18B, facing each other in the X direction with the straight line L21 or L22 being sandwiched therebetween. The cutting groove 18 has a width W2 longer than the width (diameter) of the flexible conductor 22 along the X direction. The recess 19 is adapted to temporarily hold the accommodated flexible conductor 22 and has a width W3 shorter than the width (diameter) of the flexible conductor 22.

Note that, when the connector 11 is assembled, the four guide pieces 18B formed around the cutting groove 18 are independently accommodated in the four rectangular accommodating grooves 17B formed around the cutting protrusion portion 17 illustrated in FIG. 6.

Figure 9:
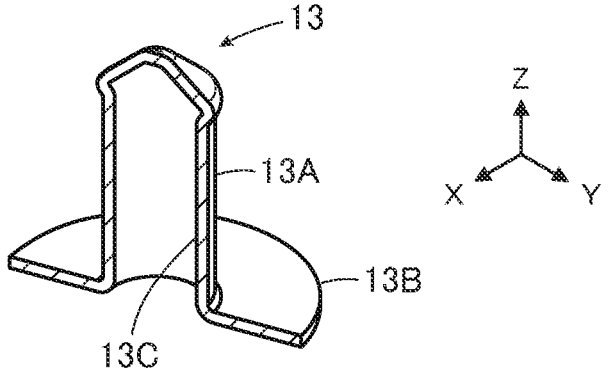
FIG. 9 is a perspective cross-sectional view illustrating a contact for use in the connector according to Embodiment 1.

As illustrated in FIG. 9, the tubular portion 13A of the contact 13 has the shape of a cylindrical tube with its +Z directional end being closed, the flange 13B is formed integrally at the −Z directional end of the tubular portion 13A, and a projection accommodating portion 13C of recess shape is provided in the tubular portion 13A. That is, the flange 13B is formed so as to surround an opening end of the projection accommodating portion 13C.

The contact 13 as above can be manufactured by, for example, press working, cutting, or drawing.

When the connector 11 is connected to the plurality of flexible conductor pieces 21, first, as illustrated in FIG. 4, the housing 12 is placed on a surface of a work bench or the like with the surface 12C facing upward so that the +Z direction faces downward and the −Z direction face upward, and the tubular portions 13A of the four contacts 13 are inserted into the four contact through-holes 12B of the housing 12 from the upper side.

Figure 10:
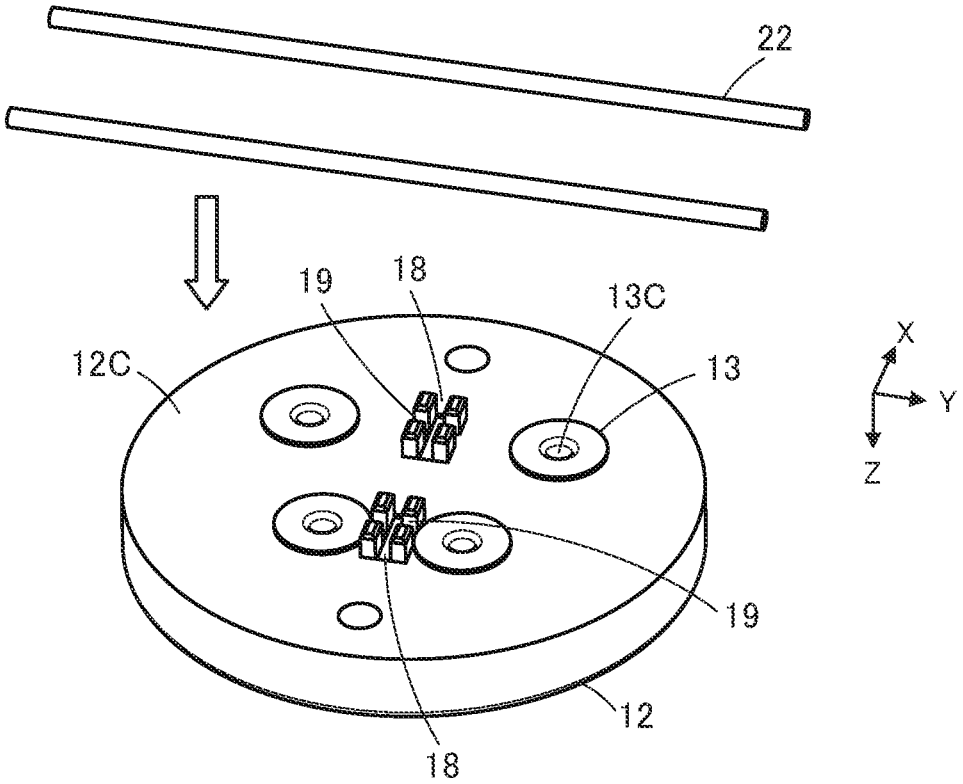
FIG. 10 is a perspective view illustrating a state in which a flexible conductor is aligned with the housing.

As a result, as illustrated in FIG. 10, the four contacts 13 are arranged in the housing 12 with the projection accommodating portions 13C facing in the −Z direction and being exposed.

Figure 11:
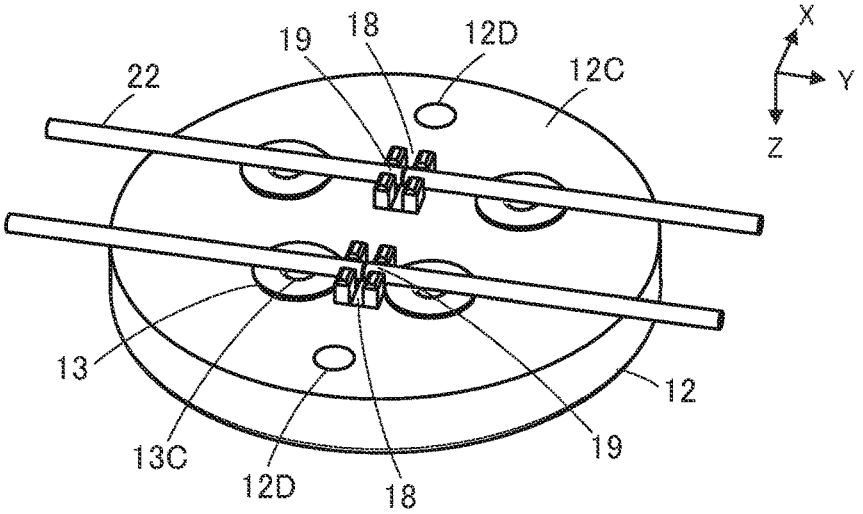
FIG. 11 is a perspective view illustrating a state in which the flexible conductor is held in the cutting groove of the housing.

Subsequently, the two flexible conductors 22 are moved from the −Z direction toward the surface 12C of the housing 12, and as illustrated in FIG. 11, middle portions of the respective flexible conductors 22 are pushed and accommodated into the recesses 19 of the guide portions 18A formed around the corresponding cutting grooves 18.

At this time, since each recess 19 has a width W3 shorter than the width (diameter) of the flexible conductor 22, as illustrated in FIG. 8, the middle portion of the flexible conductor 22 is accommodated in the recess 19 to be thereby elastically deformed and temporarily held in the recess 19.

In addition, the recesses 19 are arranged on the straight line L21 or L22. Hence, when the middle portions of the flexible conductor 22 are accommodated in the recesses 19, as illustrated in FIG. 11, each of the flexible conductors 22 is arranged to extend over the pair of contacts 13 disposed on both sides of the cutting groove 18 in the Y direction and is located immediately above the projection accommodating portions 13C of the pair of contacts 13.

In this state, the base member 14 illustrated in FIG. 5 is turned upside down and is moved toward the housing 12 from the −Z direction. At this time, first, the tips of the two housing fixing posts 16 of the base member 14 are inserted into the two post accommodating portions 12D of the housing 12, whereby the housing 12 and the base member 14 are aligned with each other in the XY directions.

When the base member 14 aligned with the housing 12 in this manner is pushed toward the housing 12, the respective projections 15 of the base member 14 start to be inserted into the projection accommodating portions 13C of the corresponding contacts 13 with the flexible conductors 22 being sandwiched between the projections 15 and the projection accommodating portions 13C. Since each of the flexible conductors 22 is arranged to extend over the pair of contacts 13 arranged on both sides of the cutting groove 18 in the Y direction, when the corresponding pair of projections 15 are inserted into the projection accommodating portions 13C of the pair of contacts 13, the flexible conductor 22 is dragged into the projection accommodating portions 13C of the pair of contacts 13 by the pair of projections 15, and tension is generated in the portion of the flexible conductor 22 located between the pair of contacts 13.

When the base member 14 is further pushed toward the housing 12, the cutting protrusion portion 17 arranged between the pair of projections 15 of the base member 14 and having the projecting height H1 shorter than the projecting height of the projection 15 is inserted into the corresponding cutting groove 18 of the housing 12, and the tip end portion 17A of the cutting protrusion portion 17 comes into contact with the middle portion of the flexible conductor 22 temporarily held in the recesses 19 formed to correspond to the cutting groove 18.

Here, the base member 14 is continued to be pushed toward the housing 12 until the tip end portion 17A of the cutting protrusion portion 17 reaches the bottom surface of the cutting groove 18, whereby the middle portion of the flexible conductor 22 is cut with the tip end portion 17A of the cutting protrusion portion 17, and the flexible conductor 22 arranged to extend over the pair of contacts 13 is divided into the pair of flexible conductor pieces 21 which separately correspond to the pair of contacts 13. Meanwhile, since the tip end portion 17A of the cutting protrusion portion 17 has the width W1 longer than the width (diameter) of the flexible conductor 22, the flexible conductor 22 is reliably cut.

In addition, since the pair of projections 15 are inserted into the projection accommodating portions 13C of the corresponding pair of contacts 13 so that tension is generated in the portion of the flexible conductor 22 located between the pair of contacts 13, the middle portion of the flexible conductor 22 can easily be cut by the tip end portion 17A of the cutting protrusion portion 17.

Figure 12:
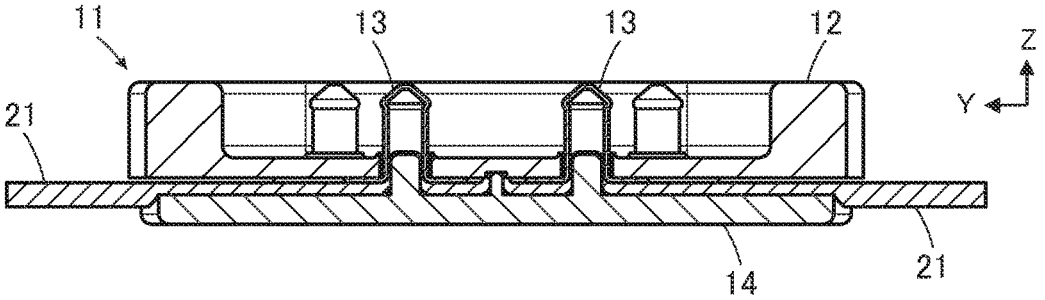
FIG. 12 is a cross-sectional view illustrating the connector according to Embodiment 1.

Since the base member 14 is pushed toward the housing 12 until the tip end portion 17A of the cutting protrusion portion 17 reaches the bottom surface of the cutting groove 18, the four projections 15 of the base member 14 are sufficiently inserted into the projection accommodating portions 13C of the corresponding contacts 13 together with the corresponding flexible conductor pieces 21. Further, the housing 12 and the base member 14 are fixed to each other as illustrated in FIG. 12 by press-fitting the two housing fixing posts 16 of the base member 14 into the two post accommodating portions 12D of the housing 12, and thus the process for connecting the connector 11 to the four flexible conductor pieces 21 is completed.

Figure 13:
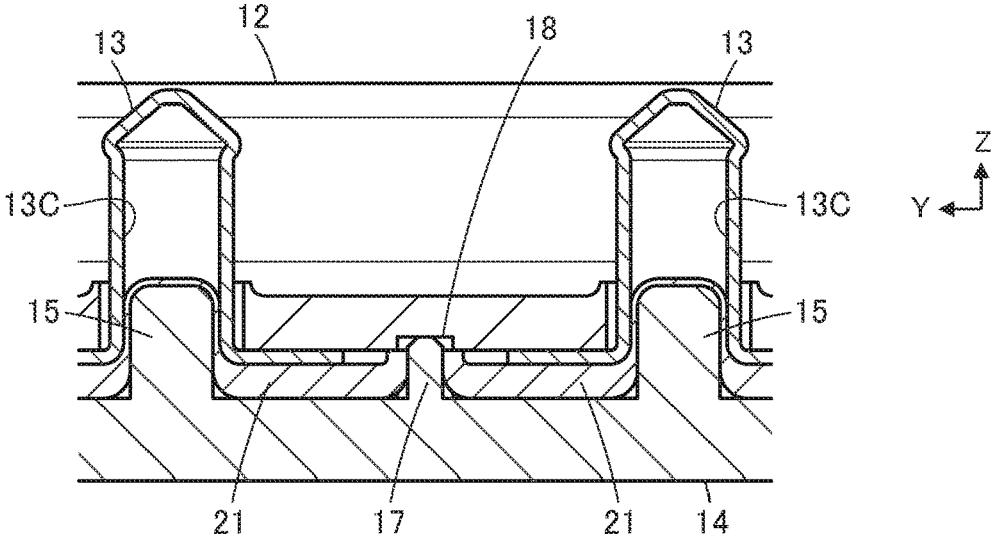
FIG. 13 is a partially enlarged view of FIG. 12.

At this time, as illustrated in FIG. 13, the pair of flexible conductor pieces 21 divided by the cutting protrusion portion 17 of the base member 14 are in a state of being separated from each other due to the presence of the cutting protrusion portion 17 sandwiched therebetween and are prevented from electrically shorting each other.

The divided pair of flexible conductor pieces 21 are separately inserted into the projection accommodating portions 13C of the corresponding contacts 13 together with the corresponding projections 15, and are sandwiched between lateral surfaces of the corresponding projections 15 and inner surfaces of the projection accommodating portions 13C of the corresponding contacts 13. As a result, the pair of flexible conductor pieces 21 come into contact with the inner surfaces of the projection accommodating portions 13C of the pair of contacts 13, and the pair of contacts 13 are electrically connected to the pair of flexible conductor pieces 21.

In this manner, by simply pushing the base member 14 toward the housing 12, the flexible conductor 22 arranged to extend over the pair of contacts 13 is cut by the cutting protrusion portion 17 of the base member 14, and the pair of contacts 13 can electrically be connected to the divided pair of flexible conductor pieces 21.

Also, in Embodiment 1, the base member 14 includes the two cutting protrusion portions 17, the housing 12 includes the two cutting grooves 18, and the two flexible conductors 22 are arranged to each extend over the corresponding pair of contacts 13. Hence, by pushing the base member 14 toward the housing 12, the two flexible conductors 22 are each divided into the pair of flexible conductor pieces 21, and the four contacts 13 are simultaneously electrically connected to the four flexible conductor pieces 21.

Accordingly, the plurality of contacts 13 can easily electrically be connected to the plurality of flexible conductor pieces 21.

Also, by dividing one flexible conductor 22 into the pair of flexible conductor pieces 21 and electrically connecting the pair of flexible conductor pieces 21 to the different contacts 13, assembling process becomes easier than in the case of individually connecting flexible conductor pieces to the corresponding contacts.

In Embodiment 1, the cutting protrusion portions 17 are arranged on the base member 14, and the cutting grooves 18 are arranged on the housing 12. Meanwhile, conversely, the cutting grooves 18 may be arranged on the base member 14, and the cutting protrusion portions 17 may be arranged on the housing 12. In this case as well, the flexible conductor 22 can be divided into the pair of flexible conductor pieces 21, and the pair of contacts 13 can electrically be connected to the pair of flexible conductor pieces 21.

While the connector 11 according to Embodiment 1 includes a total of two pairs of contacts including the pair of contacts 13 arranged in the first row R1 and the pair of contacts 13 arranged in the second row R2, the present invention is not limited to this, and the connector 11 may include only one pair of contacts or three or more pairs of contacts. In a case in which the connector 11 includes only one pair of contacts, the pair of contacts 13 are electrically connected to the pair of flexible conductor pieces 21 divided from one flexible conductor 22. In a case in which the connector 11 includes three or more pairs of contacts, the three or more flexible conductors 22 are each divided into two flexible conductor pieces 21, and two divided flexible conductor pieces 21 are electrically connected to the corresponding contacts 13.

Embodiment 2

Figure 14:
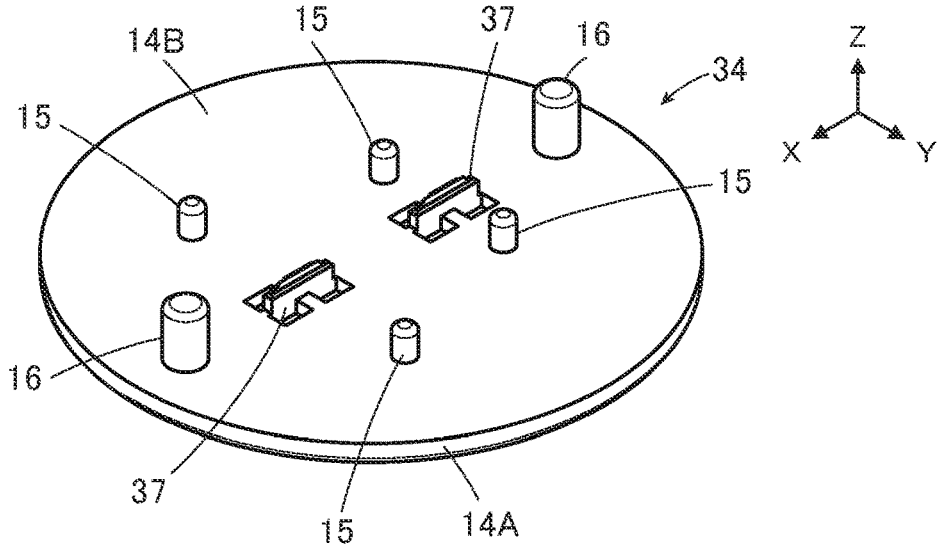
FIG. 14 is a perspective view illustrating a base member for use in a connector according to Embodiment 2.

FIG. 14 illustrates a base member 34 for use in a connector according to Embodiment 2. This base member 34 uses two cutting protrusion portions 37 in place of the two cutting protrusion portions 17 in the base member 14 used in Embodiment 1, and the other configuration thereof is similar to that of the base member 14 in Embodiment 1. That is, the four projections 15 and the two housing fixing posts 16 project on the surface 14B of the flat plate portion 14A facing in the +Z direction. Each of the two cutting protrusion portions 37 is arranged between the corresponding pair of projections 15.

Figure 15:
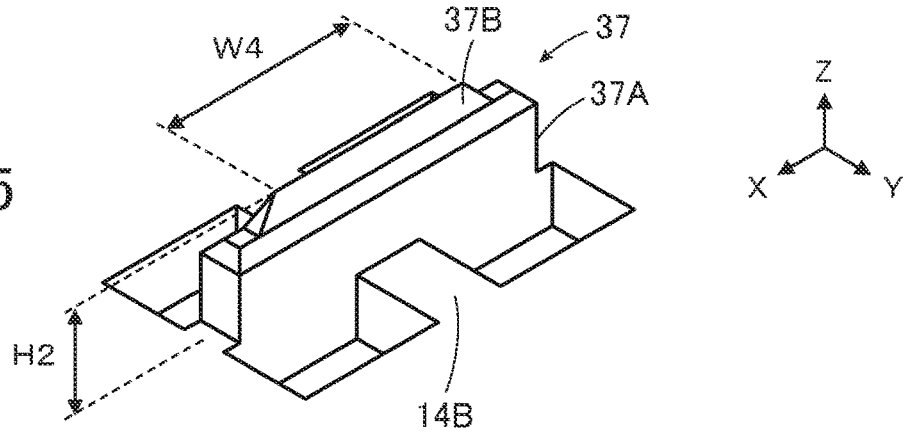
FIG. 15 is an enlarged perspective view illustrating a cutting protrusion portion formed on a base member for use in the connector according to Embodiment 2.

As illustrated in FIG. 15, the cutting protrusion portion 37 includes a flat plate-shaped protrusion portion main body 37A extending along the X direction and projecting in the +Z direction and a cutting blade 37B held on the protrusion portion main body 37A. The protrusion portion main body 37A is formed integrally with the base member 34 and is made of an insulating material such as insulating resin. The cutting blade 37B extends along the X direction, projects in the +Z direction from the +Z directional end of the protrusion portion main body 37A, and is made of metal, resin, or the like.

The cutting blade 37B has a width W4 longer than the width (diameter) of the flexible conductor 22 along the X direction, and a projecting height H2 of the cutting protrusion portion 37 from the surface 14B of the flat plate portion 14A of the base member 34 to the cutting blade 37B is shorter than the projecting height of the projection 15 from the surface 14B of the flat plate portion 14A.

The cutting blade 37B as above is arranged on each of the two cutting protrusion portions 37.

Figure 16:
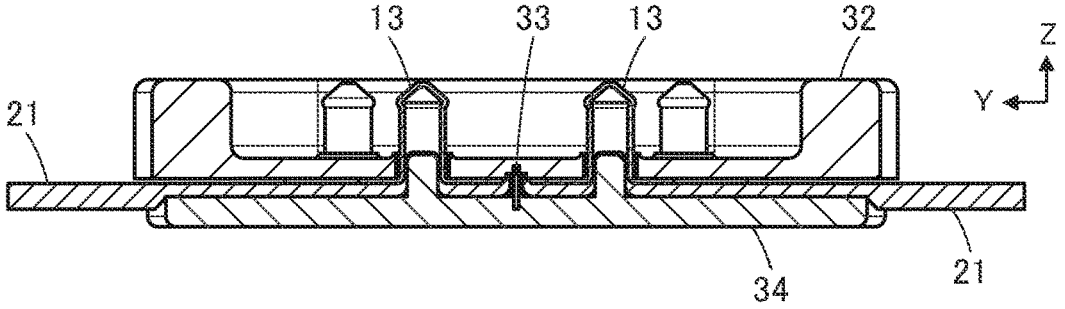
FIG. 16 is a cross-sectional view illustrating the connector according to Embodiment 2.

In the connector according to Embodiment 2, the base member 34 is attached to a housing 32 as illustrated in FIG. 16. The housing 32 is configured such that a cutting blade accommodating portion 33 of recess shape extending along the X direction is provided on the bottom surface of each of the two cutting grooves 18 in the housing 12 used in Embodiment 1, and the other configuration thereof is similar to that of the housing 12 in Embodiment 1. The cutting blade accommodating portion 33 is adapted to accommodate the cutting blade 37B of the cutting protrusion portion 37 of the base member 34 when the base member 34 is pushed into the housing 32 and has a sufficient width in the X direction and a sufficient depth in the Z direction to accommodate the cutting blade 37B.

Similarly to Embodiment 1, when the base member 34 is pushed toward the housing 32 with the flexible conductors 22 each being arranged to extend over the corresponding pair of contacts 13, the projections 15 of the base member 34 start to be inserted into the projection accommodating portions 13C of the corresponding contacts 13, the cutting protrusion portions 37 of the base member 34 are inserted into the corresponding cutting grooves 18 of the housing 32, and the cutting blades 37B of the cutting protrusion portions 37 come into contact with the middle portions of the flexible conductors 22.

Further, by pushing the base member 34 toward the housing 32, the middle portion of each of the flexible conductors 22 is cut by the cutting blade 37B of the cutting protrusion portion 37, and the flexible conductor 22 arranged to extend over the pair of contacts 13 is divided into the pair of flexible conductor pieces 21 which separately correspond to the pair of contacts 13. Meanwhile, since the cutting blade 37B has the width W4 longer than the width (diameter) of the flexible conductor 22, the flexible conductor 22 is reliably cut.

At this time, the middle portion of the flexible conductor 22 can easily be cut due to the presence of the cutting blade 37B.

Figure 17:
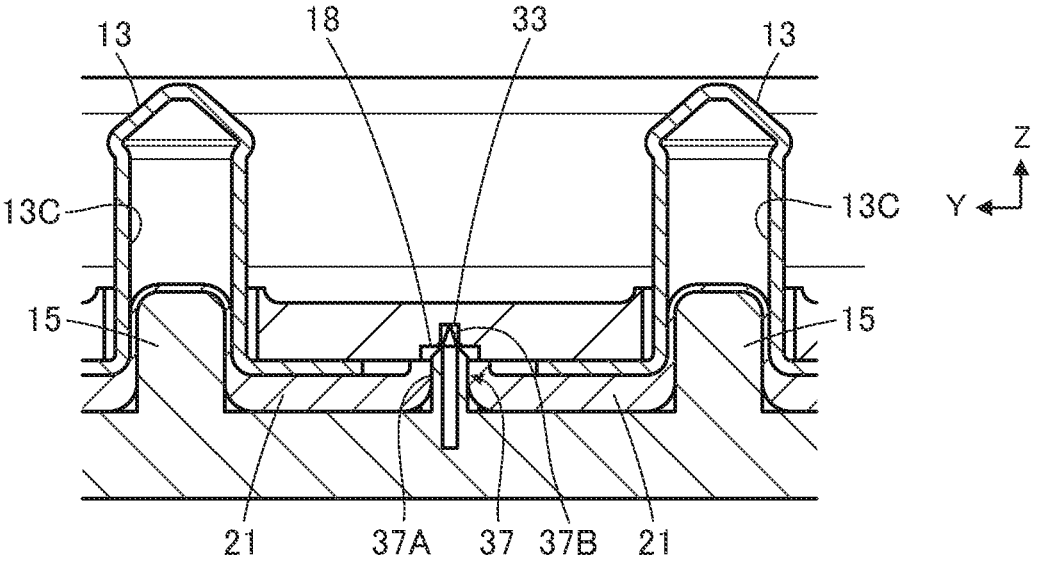
FIG. 17 is a partially enlarged view of FIG. 16.
Figure 18:
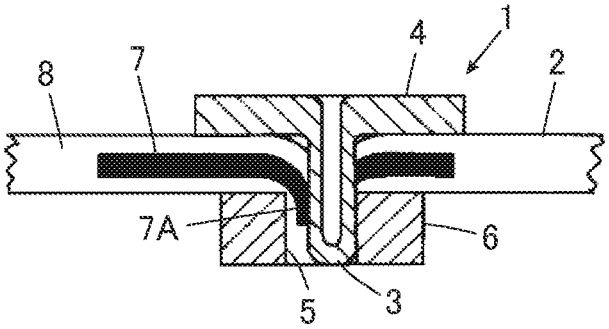
FIG. 18 PRIOR ART
FIG. 18 is a cross-sectional view illustrating a conventional connector implemented on a flat cable.

As illustrated in FIG. 17, the cutting blade 37B of the cutting protrusion portion 37 of the base member 34 is accommodated in the cutting blade accommodating portion 33 of recess shape formed on the bottom surface of the cutting groove 18 of the housing 32, and the insulating protrusion portion main body 37A is located between the pair of flexible conductor pieces 21 divided by the cutting blade 37B. Therefore, even when the cutting blade 37B is made of metal, the pair of flexible conductor pieces 21 are in a state of being separated from each other due to the presence of the protrusion portion main body 37A sandwiched therebetween and are prevented from electrically shorting each other.

The divided pair of flexible conductor pieces 21 are inserted into the projection accommodating portions 13C of the corresponding contacts 13 together with the corresponding projections 15 and are sandwiched between the lateral surfaces of the corresponding projections 15 and the inner surfaces of the projection accommodating portions 13C of the corresponding contacts 13. As a result, the pair of flexible conductor pieces 21 come into contact with the inner surfaces of the projection accommodating portions 13C of the pair of contacts 13, and the pair of contacts 13 are electrically connected to the pair of flexible conductor pieces 21.

In Embodiment 2 as well, the present invention can be applied not only to the connector including two pairs of contacts but also to a connector including only one pair of contacts or a connector including three or more pairs of contacts.

In Embodiments 1 and 2 described above, the contact 13 is connected to the flexible conductor piece 21 made of a conductive yarn. However, the present invention is not limited to this, and the contact 13 can be connected to a band-shaped flexible conductor piece in a similar manner. The band-shaped flexible conductor arranged to extend over the pair of contacts 13 may be cut and divided into a pair of band-shaped flexible conductor pieces, and these flexible conductor pieces may be connected to the corresponding contacts 13.

Also, in Embodiments 1 and 2 described above, the flexible conductor piece 21 is independently arranged between the housing 12, 32 and the base member 14, 34 without being supported by, for example, an insulating substrate main body. However, the present invention is not limited to this, and the connector according to the present invention can be connected to a band-shaped flexible substrate in which a flexible conductor is arranged to be exposed on a surface of a substrate main body made of an insulating material.

Since such a flexible substrate has the substrate main body, the process of cutting the flexible substrate is expected to be more difficult than cutting only the flexible conductor as in Embodiments 1 and 2 described above. However, by using the cutting blade 37B in Embodiment 2, for example, the flexible substrate can be cut. Meanwhile, in order to bring the flexible conductor exposed on the surface of the substrate main body into contact with the inner surface of the projection accommodating portion 13C of the contact 13 for electrical connection, the flexible substrate needs to be arranged between the base member 14, 34 and the housing 12, 32 such that the flexible conductor faces the housing 12, 32 while the rear surface of the substrate main body of the flexible substrate faces the base member 14, 34.

Also, in Embodiments 1 and 2 described above, the plug-type contact 13 is used. However, the present invention is not limited to this, and a connector in which a receptacle-type contact is similarly connected to the flexible conductor piece 21 can also be configured.

What is claimed is:

1. A connector to be connected to a flexible conductor, the connector comprising:

a base member including two or more projections;

two or more contacts made of a conductive material and including projection accommodating portions of recess shape into which the two or more projections are separately inserted;

a housing holding the two or more contacts and arranged to face the base member; and a cutting portion for cutting the flexible conductor between a pair of contacts among the two or more contacts to divide the flexible conductor into a pair of flexible conductor pieces, when a pair of projections corresponding to the pair of contacts among the two or more projections are separately inserted into the projection accommodating portions of the pair of contacts together with the flexible conductor, the flexible conductor being arranged between the base member and the housing and extending over the pair of contacts adjacent to each other, wherein the pair of flexible conductor pieces divided by the cutting portion are sandwiched between lateral surfaces of the pair of projections and inner surfaces of the projection accommodating portions of the pair of contacts and come into contact with the inner surfaces of the projection accommodating portions of the pair of contacts, whereby the pair of contacts are electrically connected to the pair of flexible conductor pieces.

2. The connector according to claim 1, wherein the cutting portion includes a cutting protrusion portion projecting on one of the base member and the housing and a cutting groove formed on the other of the base member and the housing and receiving the cutting protrusion portion when the pair of projections are inserted into the projection accommodating portions of the pair of contacts, and wherein each of the cutting protrusion portion and the cutting groove has a width longer than a width of the flexible conductor in a second direction perpendicular to a first direction along a straight line connecting the pair of projections or a straight line connecting the pair of contacts.

3. The connector according to claim 2, wherein the other of the base member and the housing on which the cutting groove is formed includes guide portions projecting on both sides of the cutting groove in the first direction, and wherein the guide portion includes a recess arranged on the straight line connecting the pair of projections or the straight line connecting the pair of contacts and adapted to accommodate the flexible conductor.

4. The connector according to claim 3, wherein the recess has a width shorter than the width of the flexible conductor in the second direction to temporarily hold the flexible conductor accommodated therein.

5. The connector according to claim 2, wherein the cutting protrusion portion has a projecting height shorter than a projecting height of the pair of projections.

6. The connector according to claim 2, wherein the cutting protrusion portion includes a cutting blade for cutting the flexible conductor.

7. The connector according to claim 1, wherein each of the two or more contacts has a tubular portion and a contact-side flange formed at one end of the tubular portion, wherein the housing includes two or more contact through-holes through which the tubular portions of the two or more contacts are passed and which are smaller than the contact-side flanges, and wherein the tubular portions of the two or more contacts are passed through the two or more contact through-holes, and the housing is fixed to the base member with the contact-side flange being pushed toward the base member, whereby the two or more contacts are fixed to the base member.

8. The connector according to claim 7, wherein the base member includes a housing fixing post projecting higher than the projection, wherein the housing includes a post accommodating portion of recess shape, and wherein the housing fixing post is accommodated in the post accommodating portion, whereby the housing is fixed to the base member.

9. The connector according to claim 1, wherein the housing is made of an insulating material.

10. The connector according to claim 1, wherein the housing includes a counter connector accommodating portion in which a part of a counter connector is to be accommodated.

11. The connector according to claim 1, wherein the base member is made of an insulating material.

12. The connector according to claim 1, wherein the flexible conductor is independently arranged between the base member and the housing.

13. The connector according to claim 1, wherein the flexible conductor is arranged to be exposed on a surface of an insulating substrate main body, and wherein the flexible conductor is arranged between the base member and the housing such that the flexible conductor faces the housing while a rear surface of the insulating substrate main body faces the base member.

14. The connector according to claim 1, wherein the contact is a plug-type contact.

15. The connector according to claim 1, wherein the contact is a receptacle-type contact.

16. A connecting method for connecting a pair of contacts held on a housing to a pair of flexible conductor pieces, the connecting method comprising:

arranging a pair of projections formed on a base member so as to face projection accommodating portions of recess shape of the pair of contacts;

arranging a flexible conductor between the housing and the base member so as to extend over the pair of contacts; and pushing the housing and the base member to each other with the flexible conductor being sandwiched therebetween to insert the pair of projections into the projection accommodating portions of the pair of contacts together with the flexible conductor and to cut the flexible conductor between the pair of contacts with a cutting portion arranged on at least one of the housing and the base member so as to divide the flexible conductor into a pair of flexible conductor pieces, and sandwiching the pair of flexible conductor pieces between lateral surfaces of the pair of projections and inner surfaces of the projection accommodating portions of the pair of contacts to bring the pair of flexible conductor pieces into contact with the inner surfaces of the projection accommodating portions of the pair of contacts, whereby the pair of contacts are electrically connected to the pair of flexible conductor pieces.

* * * * *